US007980824B2

(12) United States Patent
Niitti

(10) Patent No.: US 7,980,824 B2
(45) Date of Patent: Jul. 19, 2011

(54) ROTOR FOR A FLOTATION MACHINE

(75) Inventor: Timo Niitti, Kuopio (FI)

(73) Assignee: Outotec Oyj, Espoo (FI)

( * ) Notice: Subject to any disclaimer, the term of this patent is extended or adjusted under 35 U.S.C. 154(b) by 1118 days.

(21) Appl. No.: 11/576,327

(22) PCT Filed: Oct. 4, 2005

(86) PCT No.: PCT/FI2005/000422

§ 371 (c)(1),
(2), (4) Date: Mar. 29, 2007

(87) PCT Pub. No.: WO2006/037843

PCT Pub. Date: Apr. 13, 2006

(65) Prior Publication Data

US 2008/0063523 A1 Mar. 13, 2008

(30) Foreign Application Priority Data

Oct. 7, 2004 (FI) ..... 20041297

(51) Int. Cl.
*B03D 1/16* (2006.01)

(52) U.S. Cl. ..... 416/185; 416/231 A; 415/117; 261/91

(58) Field of Classification Search ..... 415/58.6, 415/115, 116, 117, 121.1, 121.2; 416/90 R, 416/93 R, 181, 185, 195, 231 A, 231 B, 231 R; 261/91

See application file for complete search history.

(56) References Cited

U.S. PATENT DOCUMENTS 3,479,017 A * 11/1969 Thikotter ..... 261/91
4,074,953 A * 2/1978 Budde et al. ..... 416/183

FOREIGN PATENT DOCUMENTS

| | | |
|---|---|---|
| FR | 1474582 | 2/1967 |
| GB | 1521785 | 8/1978 |
| RU | 2207917 | 7/2003 |
| SU | 1391714 | 4/1988 |
| WO | 02081093 | 10/2002 |

* cited by examiner

*Primary Examiner* — Nathaniel Wiehe

(74) *Attorney, Agent, or Firm* — Chernoff, Vilhauer, McClung & Stenzel

(57) ABSTRACT

The invention relates to a rotor of a flotation machine, particularly to a rotor, that is used for dispersing air to a slurry, and which rotor comprises alternating air ducts and slurry grooves and a collar fitted to the rotor for guiding the slurry flow into the interior of the rotor for avoiding undesired cross flow effect of the slurry flow. The rotor of the present invention efficiently prevents sanding effect and provides excellent dispersion of air into the slurry.

13 Claims, 3 Drawing Sheets

ROTOR FOR A FLOTATION MACHINE

Figure 1:
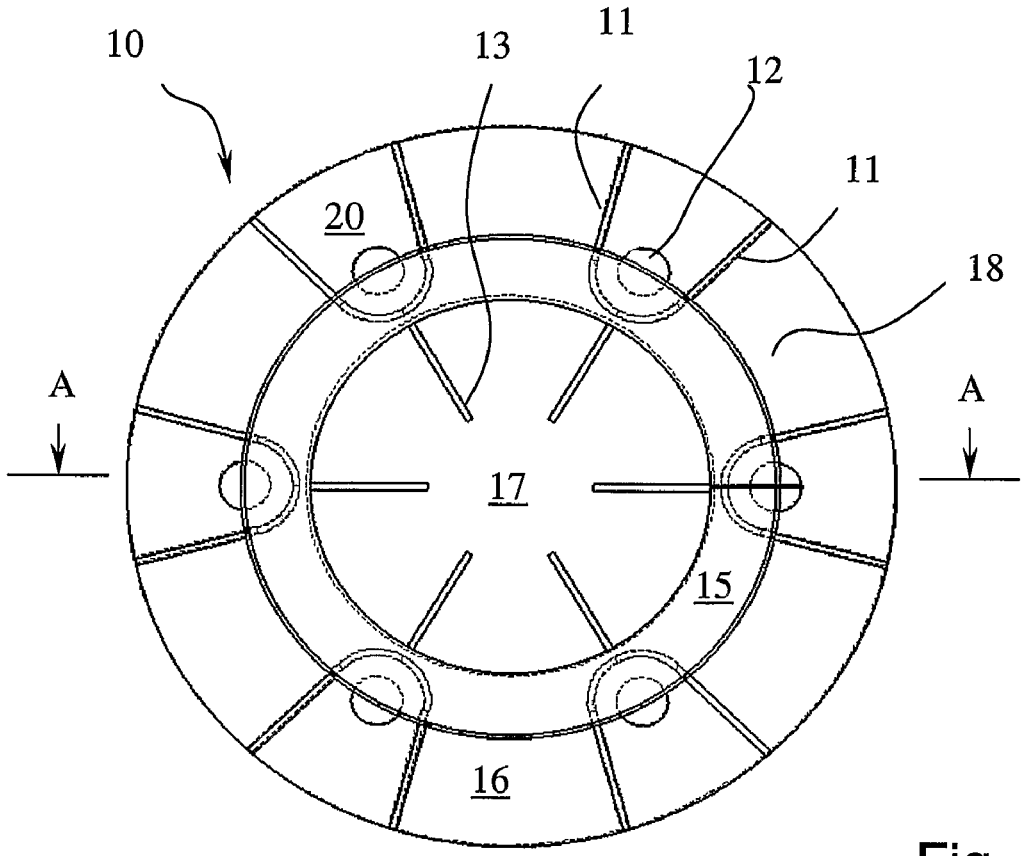

This is a national stage application filed under 35 USC 371 based on International Application No. PCT/FI2005/000422 filed Oct. 4, 2005, and claims priority under 35 USC 119 of Finnish Patent Application No. 20041297 filed Oct. 7, 2004.

The present invention relates to a flotation machine that is used for recovering valuable ingredients from slurry, such as slurry that contains minerals. In particular, the invention relates to a rotor of a flotation machine, which rotor is arranged to rotate for setting the slurry fed into the flotation cell in motion and is dispersing air into the slurry.

A flotation machine used for recovering valuable ingredients, such as metal concentrates, usually comprises a flotation cell provided with an inlet aperture for feeding slurry into the cell, and an outlet aperture for letting the non-flotated material, i.e. tailings, out of the cell. The air needed for creating the froth is fed to the rotor through a duct arranged to the shaft of the rotor. When rotating the rotor, air is fed into the slurry, and air bubbles are dispersed therein. Air bubbles flow upwards and enter the surface of the slurry where they form a froth bed. Reversed flotation is a process where valueless ingredients are made hydrophobic and the valuable material remains non-flotated and is removed as tailings from a flotation machine through a discharge opening arranged close to the bottom of the cell.

The dispersion mechanism of a flotation machine comprises a rotor and a stator. For example, U.S. Pat. No. 4,078,026 discloses a flotation cell with a rotating rotor and a stationary stator, which is arranged to encircle the rotor. The rotor fastened in a hollow vertical shaft rotates in the slurry and air is fed through the rotor into a clearance arranged between the rotor and the stator. The rotor comprises vertical blades defining alternating air ducts and slurry grooves.

WO 02/081093 discloses a rotor that comprises vertical air ducts and a cover disc whereto the air ducts are arranged. The air ducts are open at their lower ends and closed at their upper ends by the cover disc. The walls of the air ducts radially extend from the interior of the rotor to the periphery of the rotor and form vertical mixing and pumping blades of the rotor. The air ducts are arranged at essentially equal distances from one another. The air ducts define a space for the slurry in the interior of the rotor and the outer surface of the air duct walls define slurry grooves that alternate with the air ducts. The air duct walls are mutually divergent and diverge form each other in the direction proceeding outwardly from the center part of the rotor. The outer edges of the air duct walls define the periphery of the rotor. The cross sectional diameter of the rotor preferably decreases towards the lower end of the rotor. Air is conducted via air channels from the hollow shaft into the air ducts.

The present invention provides an improved rotor for a gas dispersion mechanism of a flotation machine. The rotor of the present invention is efficient in preventing sanding effect on the bottom of the flotation machine and provides efficient gas dispersion that makes the hydrophobic particles and dispersed bubbles to get into contact. An object of the present invention is to improve the performance of a prior art rotor disclosed in WO 02/081093. The rotor according to the present invention decreases cross-flow effect that has been observed in connection with the operation of the prior art rotor. Cross-flow effect means that aerated slurry returns into the dispersion mechanism immediately after having exited the mechanism. The essential novel features of the invention are enlisted in the appended claims.

The present invention is a rotor of a gas dispersion mechanism to be used in a flotation machine comprising a cover disc arranged to a rotatable shaft, air ducts that are arranged to protrude downwards from the cover disc defining a space for the slurry in the interior of the rotor. The air duct walls extend from the interior of the rotor to the periphery of the rotor thus forming mixing and pumping blades of the rotor. Slurry grooves are defined by the outer surfaces of the air duct walls, the slurry grooves being in fluid communication with the space for the slurry. Air channels are arranged for conducting air into the air ducts. A collar is arranged inside the rotor to encircle part of the slurry space and to guide the slurry flow into the interior of the rotor so as to prevent the cross-flow effect.

The collar is preferably arranged to the lower ends of the air ducts. The collar is fitted to the rotor so as to rotate along with the rotor. The collar, as being rigid and fitted to the air ducts, supports the air ducts and makes the rotor structure rigid.

Typically, the rotating shaft is hollow for providing an air channel for dispersion air to flow into the rotor. Often, the air ducts are essentially vertical and arranged at essentially equal distances from one another. According one embodiment of the invention the air ducts are open at their lower ends and closed at the upper ends by the cover disc.

According to one preferred embodiment of the present invention the number of the air ducts arranged to the cover disc and installed at equal distances from each other is six or higher and the height of the air ducts is 40-60% of the radius of the cover disc. The air duct walls are preferably mutually divergent, and they are advantageously directed towards the center of the rotor axis, so that the wall extensions intersect at the center point of the rotor. Thus the air duct walls preferably form an angle of 15-30 degrees. In addition, the design of the air ducts preferably ensures that the air duct discharge surface with respect to the slurry extends essentially uniformly from the cover disc to the bottom of the rotor. Therefore, air can be fed through the air ducts into the slurry essentially along the whole height of the rotor.

The slurry grooves and the internal slurry space defined by the air ducts and air duct walls of the rotor essentially fill the remaining rotor volume.

When rotating, the rotor of the present invention creates a pumping effect that makes the slurry flow into the internal space defined by the air ducts and the cover disc in the rotor. Majority of the slurry flow passes through a collar arranged to encircle the slurry space. The collar is preferably attached to the lower ends of the air duct walls and extends into the rotor interior and towards the cover disc a distance that preferably corresponds to one half to one sixth of the height of the air ducts. The collar may extend towards the cover even a longer distance than one half of the height of the air ducts. The total height of the collar is not limited to the height of the rotor or the air ducts, since the collar may extend outwards from the periphery of the rotor and towards the bottom of the flotation cell. The slurry exits the slurry space via slurry grooves between the air ducts.

According to the preferred embodiment of the present invention internal mixing and pumping blades are arranged to each air duct protruding towards the center of the rotor, i.e. towards the slurry space inside the rotor. According to another embodiment of the present invention an internal mixing and pumping blade is an essential part of the air duct and therefore represents an extension to an air duct.

According to the preferred embodiment of the present invention the cross section of the air ducts is U-shaped, wherein the branches of U forms the air duct wall and the mixing blades of the rotor.

According to another embodiment of the present invention the cross section of the air duct is angular. According to one more embodiment of the present invention the cross section of the air duct is V-shaped.

Figure 2:
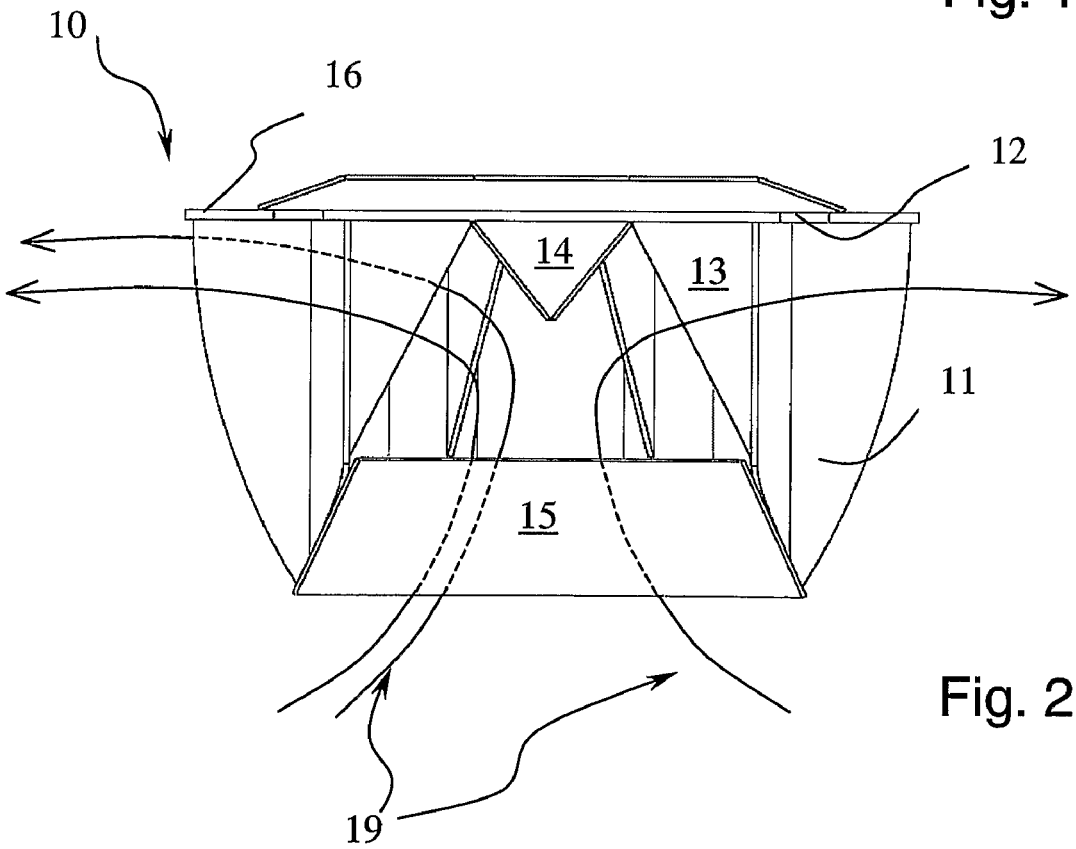
Figure 3:
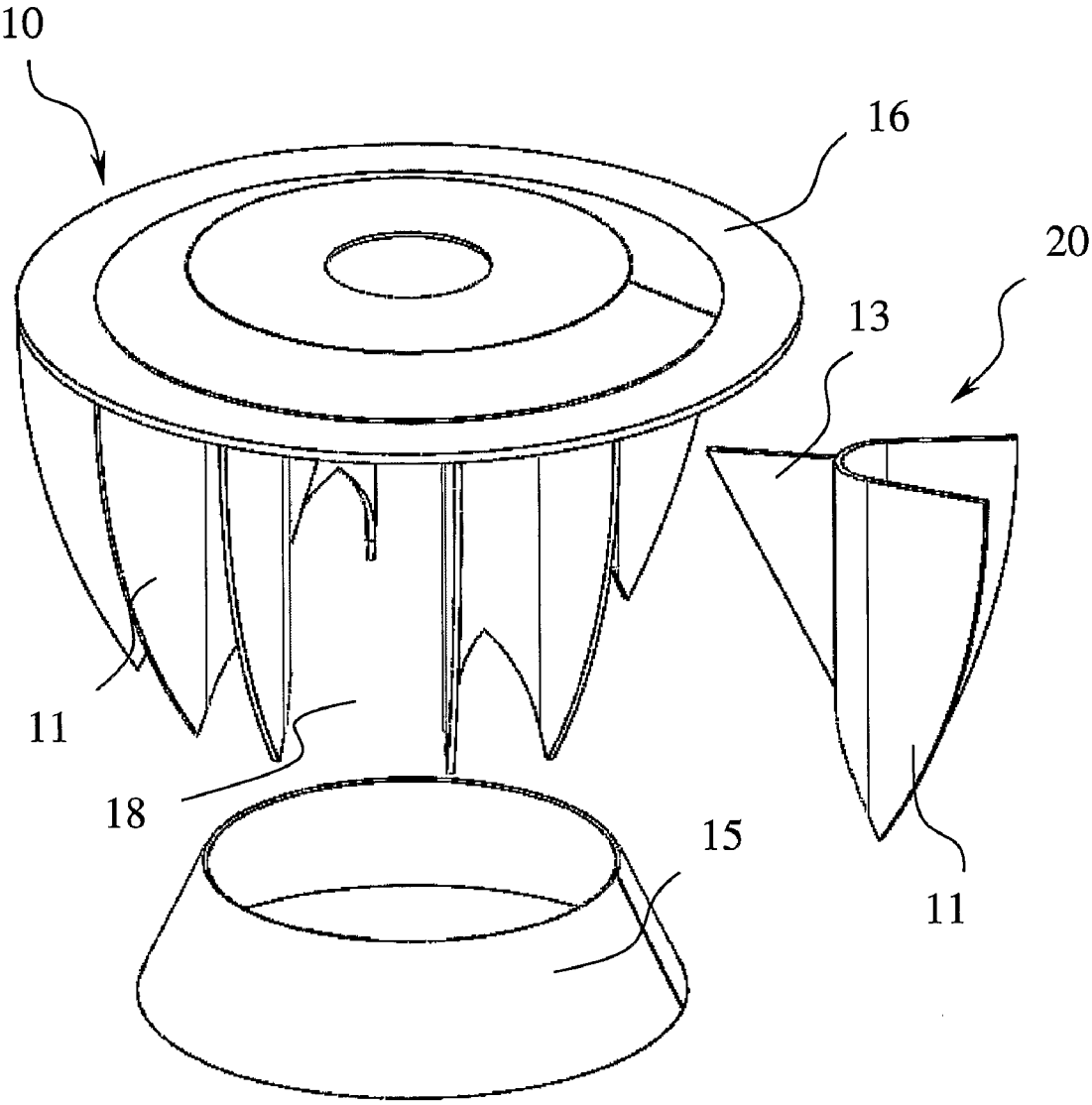
Figure 4:
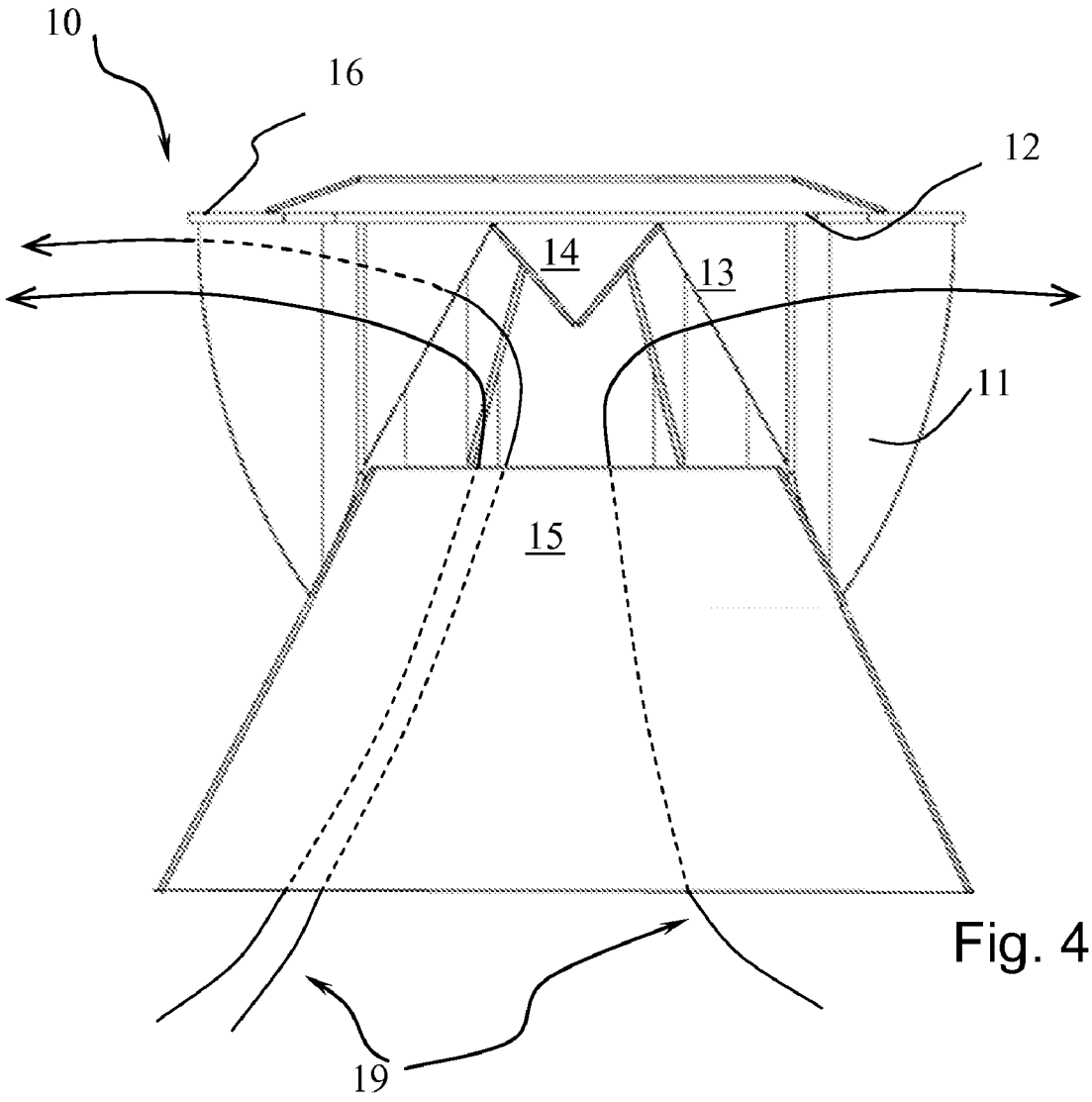

The invention is described in more detail below with reference the appended drawings, where FIG. 1 is a schematic illustration of a preferred embodiment of the invention, seen from below, FIG. 2 shows a cross sectional side view A-A of the embodiment of FIG. 1 , FIG. 3 shows a perspective exploded view of the preferred embodiment of FIG. 1 and FIG. 2, and FIG. 4 shows a cross sectional side view of a second embodiment.

The rotor of FIGS. 1-3 is arranged to a hollow shaft (not shown) via a cover disc 16. Air ducts 20 are attached to the cover disc 16. The walls defining the air ducts 20 extend along the cover disc, starting from the outer edge of the cover disc 16, radially towards the center of the disc a distance that is 50% of the length of the radius of the cover disc 16.

The air duct walls are mutually divergent and the extension lines of the walls intersect at the center point of the rotor. The air duct walls diverge from each other in an angle of 20 degrees.

Channels for conducting air from the hollow shaft to the air ducts are arranged inside the cover disc. Air flow enters the air ducts via apertures 12 arranged to the cover disc 16. The aperture for the air to enter the air duct may be arranged at any point of the walls defining the air duct. According to another embodiment of the invention, air is introduced into the air duct through a channel arranged inside an air duct extension 13.

The slurry grooves 18 defined by the outer surface of the air duct wall are in fluid communication with the slurry space 17 that is provided for the slurry in the center part of the rotor 10.

The rotor creates a pumping effect and suction that draws the slurry into the rotor. The slurry flow enters the rotor via a collar 15 arranged to encircle part of the slurry space 17. The collar 15 is attached to the air duct walls 11 at their lower end and the collar 15 extends from the bottom of the rotor 10 towards the cover disc 16 by a distance that is 25% of the height of the air ducts 20. In the second embodiment, shown in FIG. 4, the collar extends outward from the outer edges of the air duct walls and towards the bottom of the flotation cell.

A slurry flow guide 14 is arranged to the bottom of the cover disc 16 to enhance the slurry to exit the interior 17 of the rotor 10. Arrows 19 indicate the direction of the main stream of the slurry flow.

Internal mixing and pumping blades 13 are arranged to extend from the air ducts towards the center of the rotor. In this embodiment the internal mixing and pumping blades are triangle plate elements spanning between the air duct walls 11, the bottom of the cover disc and the slurry flow guide 14.

EXAMPLE

The various benefits of this invention can be seen in the following test results, where the rotor of our invention was tested against a prior art rotor disclosed in U.S. Pat. No. 4,078,026 having the same diameter and rotation speed. Sanding effect and air hold-up performances were monitored. In this context sanding means the amount of solid particles lying on the bottom of the flotation cell, usually measured in thickness of the solids layer. The higher is the amount, the smaller is the effective volume of the cell. The inactive particles (both valuable and gangue) also have a tendency to form hard mud, which makes maintenance work difficult. The hardened material can detach in large chunks and cause failure in the flotation cell impellers and valves. Air hold-up is the total volume of air bubbles contained in the cell. Volume is defined by quantity and size. Usually, the volume is measured as percentage of the total cell volume. The higher the quantity is, the more opportunities there are for bubble-particle attachment. The smaller the bubbles, the higher is the volume due to weaker buoyancy force and thus slower rise velocity. Thus, the theoretical ultimate aim would be to disperse a maximum number of bubbles, which are just big enough to carry the mass of the particle.

Sanding was completely eliminated in conditions where standard rotor left 17% of the sand at the bottom of the tank.

The efficiency of air dispersion was improved. In water the standard rotor could create an air hold-up of 11.5% and this improved rotor could increase the air hold-up to 22% with the same air flow. The reason for increased air hold-up is that the air bubbles created by the improved rotor were smaller and thus remained a longer time in the cell.

In an industrial scale test at 40% solids by weight, the rotor of this invention was able to disperse 20 $m^3$/min of air against 14 $m^3$/min by a standard rotor.

The invention claimed is:

1. A rotor of a gas dispersion mechanism to be used in a flotation machine, the rotor comprising:

a cover disc for attachment to a rotatable shaft, air ducts extending downward from the cover disc in an outer region of the rotor for delivering air to the periphery of the rotor whereby the rotor defines a space for the slurry inward of the air ducts, the air ducts being defined by air duct walls extending from the interior of the rotor to the periphery of the rotor and forming mixing and pumping blades of the rotor, wherein outer surfaces of the air ducts define slurry grooves that are in fluid communication with the space for the slurry, air channels for conducting air into the air ducts, and a collar disposed below the cover disc and encircling part of the slurry space for guiding the slurry flow into the interior of the rotor, and wherein the collar has an upper edge and the air duct walls have lower end portions that extend downward beyond the upper edge of the collar and are disposed outward of the collar.

2. The rotor according to claim 1, wherein the collar is attached to the lower end portions of the air duct walls.

3. The rotor according to claim 1, wherein the collar has a lower edge forming a the bottom line of the rotor and the collar extends upward from the bottom line of the rotor a distance that is between one half to one sixth of the height of the air duct walls.

4. The rotor according to claim 1, wherein the collar extends outwards and downwards from outer edges of the air duct walls.

5. The rotor according to claim 1, wherein the shape of the collar is a truncated cone.

6. The rotor according to claim 1, wherein the height of the air ducts is 40-60% of the length of the radius of the cover disc.

7. The rotor according to claim 1, wherein the walls of the air ducts are mutually divergent and diverge from each other in an angle of 15-30 degrees.

8. The rotor according to claim 1, wherein each air duct has two air duct walls that extend substantially radially of the rotor.

9. The rotor according to claim 8, wherein the two air duct walls of each air duct diverge outwardly of the rotor at an angle in the range from 15 to 30 degrees.

10. The rotor according to claim 1, wherein the cover disc is formed with channels for supplying air to the air ducts.

11. The rotor according to claim 1, wherein the rotor comprises at least six air ducts.

12. The rotor according to claim 1, further comprising internal mixing blades protruding from each air duct towards the center of the rotor.

13. The rotor according to claim 1, wherein the cover disc comprises a bottom plate formed with apertures communicating with the air ducts and also comprises a top plate spaced from the bottom plate and formed with a central opening, whereby the space between the bottom plate and the top plate defines a channel for conducting air from the central opening in the top plate to the apertures in the bottom plate.

* * * * *